US012467457B2

(12) United States Patent
Bonnefoi et al.

(10) Patent No.: US 12,467,457 B2
(45) **Date of Patent: *Nov. 11, 2025**

(54) SCROLL COMPRESSOR AND METHOD FOR CONTROLLING SCROLL COMPRESSOR

(71) Applicant: Danfoss Commercial Compressors, Trevoux (FR)

(72) Inventors: Patrice Bonnefoi, Nordborg (DK); Wanzhen Liu, Nordborg (DK); David Genevois, Cailloux sur Fontaine (FR); Jean Francois Heitz, Nordborg (DK)

(73) Assignee: DANFOSS COMMERCIAL COMPRESSORS, Reyrieux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 18/928,944

(22) Filed: Oct. 28, 2024

(65) Prior Publication Data

US 2025/0052240 A1 Feb. 13, 2025

Related U.S. Application Data

(63) Continuation of application No. 18/573,467, filed as application No. PCT/CN2022/099879 on Jun. 20, 2022.

(30) Foreign Application Priority Data

Jun. 25, 2021 (CN) ..... 202110715924.X

(51) Int. Cl.
*F04C 18/02* (2006.01)
*F04C 23/00* (2006.01)
(Continued)

(52) U.S. Cl.
CPC ..... *F04C 18/0215* (2013.01); *F04C 23/008* (2013.01); *F04C 23/02* (2013.01);
(Continued)

(58) Field of Classification Search
CPC .... F04C 18/0215; F04C 23/008; F04C 23/02; F04C 23/001; F04C 28/28; F04C 29/04;
(Continued)

(56) References Cited

U.S. PATENT DOCUMENTS 6,490,882 B2 * 12/2002 Tipton ..... F25B 47/006 62/324.1
11,994,126 B2 * 5/2024 Mlsna ..... F04C 18/0215
(Continued)

FOREIGN PATENT DOCUMENTS

CN 102725600 A 10/2012
CN 105026853 A 11/2015
(Continued)

OTHER PUBLICATIONS

Summary English translation of Chinese Office Action, in connection with corresponding Chinese Pat. App. No. 202110715924.X, dated Jan. 9, 2025.

*Primary Examiner* — Dapinder Singh
(74) *Attorney, Agent, or Firm* — McCormick, Paulding & Huber PLLC

(57) ABSTRACT

A scroll compressor (2) includes a sealed housing (3); a compression unit (11), having a fixed scroll (12) and an orbiting scroll (13); a drive shaft (18) configured to drive the orbiting scroll (13) to move orbitally, the drive shaft (18) being capable of rotating about an axis of rotation; a synchronous reluctance motor (15) configured to drive the drive shaft (18) to rotate about the axis of rotation, the synchronous reluctance motor (15) comprising a rotor (16) coupled to the drive shaft (18) and a stator (17) disposed around the rotor (16), and the rotor (16) including a ferrite permanent magnet (23); a compressor control apparatus (31) configured to control the scroll compressor (2) to operate; a lubricating oil tank (27), formed in a bottom portion of the sealed housing (3); a heating apparatus configured to heat
(Continued)

lubricating oil stored in the lubricating oil tank (27); and an oil temperature sensor (28) disposed in the lubricating oil tank (27).

20 Claims, 4 Drawing Sheets

(51) Int. Cl.
*F04C 23/02* (2006.01)
*F04C 28/28* (2006.01)
*F04C 29/02* (2006.01)
*F04C 29/04* (2006.01)

(52) U.S. Cl.
CPC ..... *F04C 28/28* (2013.01); *F04C 29/02* (2013.01); *F04C 29/04* (2013.01); *F04C 2240/40* (2013.01); *F04C 2240/81* (2013.01); *F04C 2270/195* (2013.01)

(58) Field of Classification Search
CPC .. F04C 29/12; F04C 2240/40; F04C 2240/81; F04C 2240/30; F04C 2270/195
See application file for complete search history.

(56) References Cited

U.S. PATENT DOCUMENTS

| | | | | |
|---|---|---|---|---|
| 12,215,687 | B2 * | 2/2025 | Bonnefoi | F04C 18/0215 |
| 2005/0175492 | A1 * | 8/2005 | Hirooka | F04C 29/026 417/440 |
| 2010/0003147 | A1 * | 1/2010 | Takahashi | F04C 23/008 418/83 |
| 2014/0044562 | A1 | 2/2014 | Lee et al. | |
| 2016/0018148 | A1 * | 1/2016 | Yura | F04C 29/028 62/192 |
| 2020/0227959 | A1 * | 7/2020 | Yim | H02K 1/276 |

FOREIGN PATENT DOCUMENTS

| | | | |
|---|---|---|---|
| CN | 105473856 | A | 4/2016 |
| CN | 106288570 | A | 1/2017 |
| CN | 110762914 | A | 2/2020 |
| CN | 212486356 | U | 2/2021 |
| JP | 2002354888 | A | 12/2002 |

* cited by examiner

SCROLL COMPRESSOR AND METHOD FOR CONTROLLING SCROLL COMPRESSOR

CROSS-REFERENCE TO RELATED APPLICATIONS

This application is a continuation of U.S. patent application Ser. No. 18/573,467, filed Dec. 22, 2023, which is a National Stage application of International Patent Application No. PCT/CN2022/099879, filed on Jun. 20, 2022, which claims priority to Chinese Patent Application No. 202110715924.X, filed Jun. 25, 2021, each of which is hereby incorporated by reference in its entirety.

TECHNICAL FIELD

The present invention relates to a scroll compressor, and in particular relates to a scroll refrigeration compressor.

BACKGROUND

U.S. Ser. No. 10/090,793 B2 discloses a compressor, the compressor comprising an electric motor and a heating element, the electric motor comprising a ferrite permanent magnet, the ferrite permanent magnet being arranged in a rotor slot on a rotor of the electric motor, and the heating element also being arranged in the rotor slot and near the ferrite permanent magnet. Compared with a rare-earth element magnet, a ferrite permanent magnet is inexpensive but is sensitive to operating at low temperatures (such as below −20 degrees centigrade). When the temperature of the rotor is less than a predetermined threshold, the heating element is specially endowed with energy to prevent demagnetization of the ferrite permanent magnet.

This type of heating element is expensive, and mounting such heating elements together with ferrite permanent magnets in rotor slots is difficult and expensive.

SUMMARY

An object of the present invention is to provide an improved scroll compressor, wherein said scroll compressor may overcome a defect encountered in a conventional scroll compressor.

In particular, the object of the present invention is to provide an intelligent scroll compressor provided with a ferrite permanent magnet synchronous reluctance motor, wherein, at a lower cost, a ferrite permanent magnet is prevented from demagnetizing at a low temperature.

Another object of the present invention is provide expanded control and protection features with very limited additional costs and without needing additional components.

According to the present invention, this type of scroll compressor comprises:

- a sealed housing, the sealed housing being provided with a suction opening, and the suction opening being configured to supply refrigerant to be compressed to the scroll compressor;
- a compression unit, the compression unit being arranged in the sealed housing and being configured to compress refrigerant supplied by the suction opening, and the compression unit comprising a fixed scroll and an orbiting scroll;
- a drive shaft, the drive shaft being arranged in the sealed housing and being configured to drive the orbiting scroll of the compression unit to move orbitally, and the drive shaft being capable of rotating around an axis of rotation;
- a synchronous reluctance motor, the synchronous reluctance motor being arranged in the sealed housing and being configured to drive the drive shaft to rotate around the axis of rotation, the synchronous reluctance motor comprising a rotor, coupled to the drive shaft, and a stator disposed around the rotor, and the rotor comprising a ferrite permanent magnet;
- a compressor control apparatus, the compressor control apparatus being configured to control the operation of the scroll compressor;
- a lubricating oil tank, the lubricating oil tank being formed in a bottom portion of the sealed housing;
- a heating apparatus, the heating apparatus being configured to heat lubricating oil stored in the lubricating oil tank; and
- an oil temperature sensor, the oil temperature sensor being arranged in the lubricating oil tank.

Since magnet costs are lower, a synchronous reluctance motor provided with a ferrite permanent magnet is a solution applied to cost-sensitive variable-speed scroll compressors which has attracted attention. Compared with a rare-earth magnet, a temperature restriction of a ferrite permanent magnet may be managed, in a scroll compressor according to the present invention, by means of introducing an oil temperature sensor in a lubricating oil tank. A lubricating oil temperature measured by the temperature sensor may act as an indication of a temperature of a rotor ferrite permanent magnet, because generally there is a good thermal connection between the lubricating oil tank and the rotor ferrite permanent magnet, for example, via a drive shaft or via a stator; said drive shaft is fixed on the rotor of the synchronous reluctance motor and may be dipped into the oil tank, and said stator is fixed to the sealed housing.

Together with a heating apparatus for the lubricating oil tank, operations of the synchronous reluctance motor and scroll compressor may be easily controlled even at low temperatures, and damage to the scroll compressor may be prevented.

For example, at a low temperature measured by the oil temperature sensor, the operation of the synchronous reluctance motor may be controlled by means of restricting a motor current and therefore restricting a capacity of the scroll compressor, until a predetermined temperature threshold is reached. Before, for example, starting the heating apparatus to increase the temperature of the lubricating oil to reach a specific temperature level, operation of the synchronous reluctance motor may be disallowed at a very low temperature.

The presence of an oil heating apparatus and oil temperature sensor has further advantages for operation control and protection of the compressor.

The scroll compressor further may comprise one or more of the following features individually or in combination.

According to an embodiment of the present invention, the compressor control apparatus is configured to collect a lubricating oil temperature measured by the oil temperature sensor, and to prevent the synchronous reluctance motor from starting, if the lubricating oil temperature measured by the oil temperature sensor is less than a first predetermined temperature value.

According to an embodiment of the present invention, the compressor control apparatus is configured to start the synchronous reluctance motor, if the lubricating oil temperature measured by the oil temperature sensor is greater than or equal to the first predetermined temperature value.

According to an embodiment of the present invention, the compressor control apparatus is configured to start the heating apparatus, if the lubricating oil temperature measured by the oil temperature sensor is less than the first predetermined temperature value.

According to an embodiment of the present invention, the compressor control apparatus is configured to stop the heating apparatus, if the lubricating oil temperature measured by the oil temperature sensor is greater than or equal to the first predetermined temperature value.

According to an embodiment of the present invention, the compressor control apparatus is configured to apply a limited motor current to the synchronous reluctance motor, if the lubricating oil temperature measured by the oil temperature sensor is between the first predetermined temperature value and a second predetermined temperature value greater than the first predetermined temperature value.

According to an embodiment of the present invention, the limited motor current is defined by the compressor control apparatus, such that the rotational speed of the rotor is less than 10 rps, for example less than 5 rps.

According to an embodiment of the present invention, the compressor control apparatus is configured to:

collect a saturation temperature of refrigerant sucked in at a suction opening of the scroll compressor;

compare a lubricating oil temperature measured by the oil temperature sensor with the collected saturation temperature; and if a temperature difference between the measured lubricating oil temperature and the collected saturation temperature is less than a threshold, start the heating apparatus and prevent the synchronous reluctance motor from starting.

The saturation temperature may be derived from a suction pressure measured by a suction pressure sensor located at the suction opening or near the suction opening, or is provided by a system controller connected to the compressor control apparatus. This type of temperature difference between the lubricating oil temperature and saturation temperature is also called oil overheating and corresponds to an overheating degree of lubricating oil in the lubricating oil tank, and said temperature difference allows estimation of the presence of liquid refrigerant in a low-pressure chamber of the scroll compressor and the amount of said liquid refrigerant.

By means of using the heating apparatus to heat lubricating oil held in the lubricating oil tank before starting the synchronous reluctance motor, a flooded start and liquid refrigerant impacts which may result in damage to the scroll compressor may be prevented.

According to an embodiment of the present invention, the compressor control apparatus is configured to detect an expansion valve fault, if a temperature difference between the lubricating oil temperature and collected saturation temperature, during an operating period of the scroll compressor, is less than a predetermined value. In fact, low oil overheating caused by high liquid refrigerant flooding, observed during a scroll compressor operating period, allows an expansion valve fault to be detected.

According to an embodiment of the present invention, the compressor control apparatus is configured to detect a fault or even failure of a lubricating oil tank heater, by means of monitoring the lubricating oil temperature measured by the oil temperature sensor.

According to an embodiment of the present invention, the heating apparatus comprises a resistance heater.

According to an embodiment of the present invention, the resistance heater is arranged in the lubricating oil tank in the sealed housing.

According to an embodiment of the present invention, the resistance heater is fixed to a midshell of the sealed housing or a base plate of the sealed housing.

According to an embodiment of the present invention, the resistance heater is arranged on an outer surface of the sealed housing, and is positioned immediately adjacent to the lubricating oil tank. The resistance heater may be arranged on an outer surface of the midshell of the sealed housing or on an outer surface of a bottom portion of the base plate of the sealed housing.

According to an embodiment of the present invention, the resistance heater at least partially extends around the lubricating oil tank.

According to an embodiment of the present invention, the scroll compressor further comprises a variable speed drive connected to the synchronous reluctance motor, and the compressor control apparatus is configured to cause the variable speed drive to operate in a stator heating mode, and, in the stator heating mode, the variable speed drive applies a direct current to a stator winding of the stator, such that the stator winding generates heat to heat the lubricating oil stored in the lubricating oil tank, and the stator of the synchronous reluctance motor acts as a heating apparatus. In particular, if the lubricating oil temperature measured by the oil temperature sensor is less than a first predetermined temperature value, the variable speed drive operates in the stator heating mode.

According to an embodiment of the present invention, the stator is thermally connected to the lubricating oil tank. The stator may be thermally connected to the lubricating oil tank via the sealed housing.

According to an embodiment of the present invention, a lower end of the stator is dipped in the lubricating oil tank. The thermal connection from the stator to the lubricating oil tank is therefore a thermal connection made in a direct way.

According to an embodiment of the present invention, the rotor comprises a rotor lamination stack, the rotor lamination stack is provided with a receiving slot, and a ferrite permanent magnet is arranged in the receiving slot.

According to an embodiment of the present invention, at least one ferrite permanent magnet is arranged in each receiving slot.

According to an embodiment of the present invention, each receiving slot is only partially filled with the corresponding said at least one ferrite permanent magnet.

According to an embodiment of the present invention, multiple ferrite permanent magnets are arranged in each receiving slot.

According to an embodiment of the present invention, each ferrite permanent magnet extends substantially parallel to a longitudinal axis of the rotor.

According to an embodiment of the present invention, each receiving slot extends substantially parallel to the longitudinal axis of the rotor.

According to an embodiment of the present invention, the receiving slots comprise:

four radial outer receiving slots, the four radial outer receiving slots being distributed at angles around the longitudinal axis of the rotor, and two ferrite permanent magnets being arranged in each one of the four radial outer receiving slots; and four radial inner receiving slots, the four radial inner receiving slots being distributed at angles around the longitudinal axis of the rotor, and three ferrite permanent magnets being arranged in each one of the four radial inner receiving slots.

According to an embodiment of the present invention, the rotor lamination stack comprises an air section formed near an end portion, of the receiving slot, facing a radial outer surface of the rotor. Advantageously, the rotor lamination stack comprises an air section formed near an end portion, of each receiving slot, facing the radial outer surface of the rotor.

According to an embodiment of the present invention, each receiving slot comprises a longitudinal center portion and two longitudinal side portions, the corresponding said at least one ferrite permanent magnet is arranged in the longitudinal center portion, and the two longitudinal side portions form corresponding air sections. Advantageously, each receiving slot further comprises two partition wall portions, and each partition wall portion separates the corresponding longitudinal center portion from the corresponding air section.

According to an embodiment of the present invention, the rotor lamination stack comprises a bridge section formed between the air section and the radial outer surface of the rotor.

According to an embodiment of the present invention, the rotor lamination stack comprises multiple slender recesses formed in the radial outer surface of the rotor, each slender recess is located between two adjacent bridge sections respectively associated with a radial outer receiving slot and a radial inner receiving slot, and a deepest point of each slender recess is located near the adjacent bridge section associated with the corresponding radial inner receiving slot. These slender recesses result in a non-uniform air gap between the rotor and stator, which reduces torque fluctuations as a result of causing the flux density of the air gap between the outer periphery of the rotor and inner circumference of the stator to approach a sine curve.

According to an embodiment of the present invention, each slender recess extends substantially parallel to the longitudinal axis of the rotor.

According to an embodiment of the present invention, an air gap is defined between the stator and the rotor.

According to an embodiment of the present invention, the rotor is a four-pole rotor.

According to an embodiment of the present invention, the synchronous reluctance motor is a variable-speed synchronous reluctance motor.

According to an embodiment of the present invention, the stator is fixed to the midshell of the sealed housing.

The present invention further relates to a method for controlling a scroll compressor, the method comprising:

providing a scroll compressor according to the present invention;

measuring a lubricating oil temperature in a lubricating oil tank; and according to the measured lubricating oil temperature, controlling a synchronous reluctance motor and/or heating apparatus.

According to an embodiment of the present invention, the method comprises:

if the measured lubricating oil temperature is less than a first predetermined temperature value, preventing the synchronous reluctance motor from starting.

According to an embodiment of the present invention, the method comprises:

if the measured lubricating oil temperature is greater than or equal to the first predetermined temperature value, starting the synchronous reluctance motor.

According to an embodiment of the present invention, the method comprises:

if the measured lubricating oil temperature is less than the first predetermined temperature value, heating the lubricating oil held in the lubricating oil tank.

According to an embodiment of the present invention, the method comprises:

if the measured lubricating oil temperature is between the first predetermined temperature value and a second predetermined temperature value greater than the first predetermined temperature value, applying a limited motor current to the synchronous reluctance motor.

According to an embodiment of the present invention, the method comprises:

collecting a saturation temperature of refrigerant sucked in at a suction opening of the scroll compressor;

comparing the measured lubricating oil temperature with the collected saturation temperature; and if a temperature difference between the measured lubricating oil temperature and the collected saturation temperature is less than a threshold, heating the lubricating oil held in the lubricating oil tank and preventing the synchronous reluctance motor from starting.

BRIEF DESCRIPTION OF THE DRAWINGS

When reading with reference to the drawings, the following detailed explanations of several embodiments of the present invention may be better understood; however, it should be understood that the present invention is not limited to the specific embodiments disclosed.

DETAILED DESCRIPTION

Figure 1:
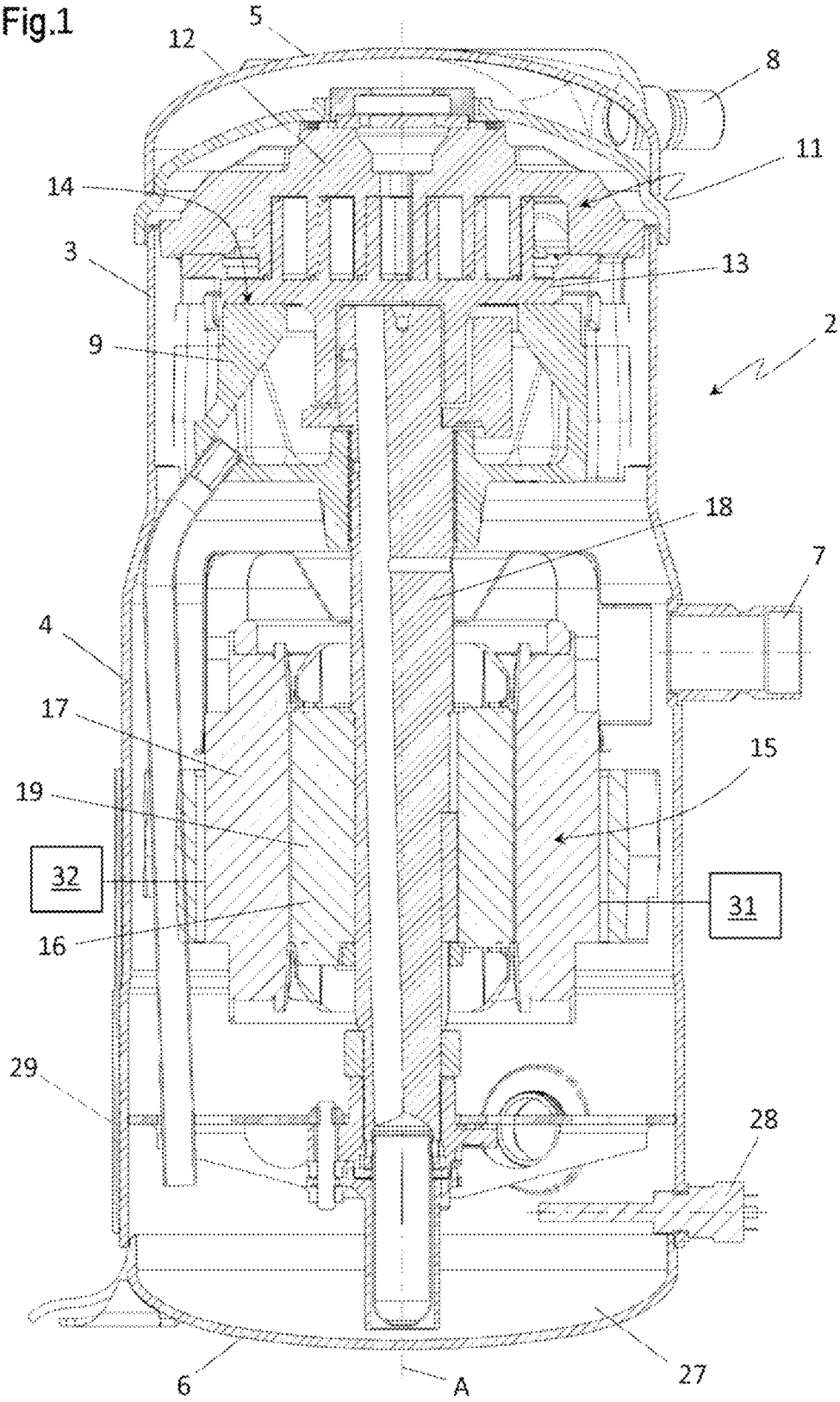
FIG. 1 is a longitudinal sectional view of a scroll compressor according to a first embodiment of the present invention.
Figure 2:
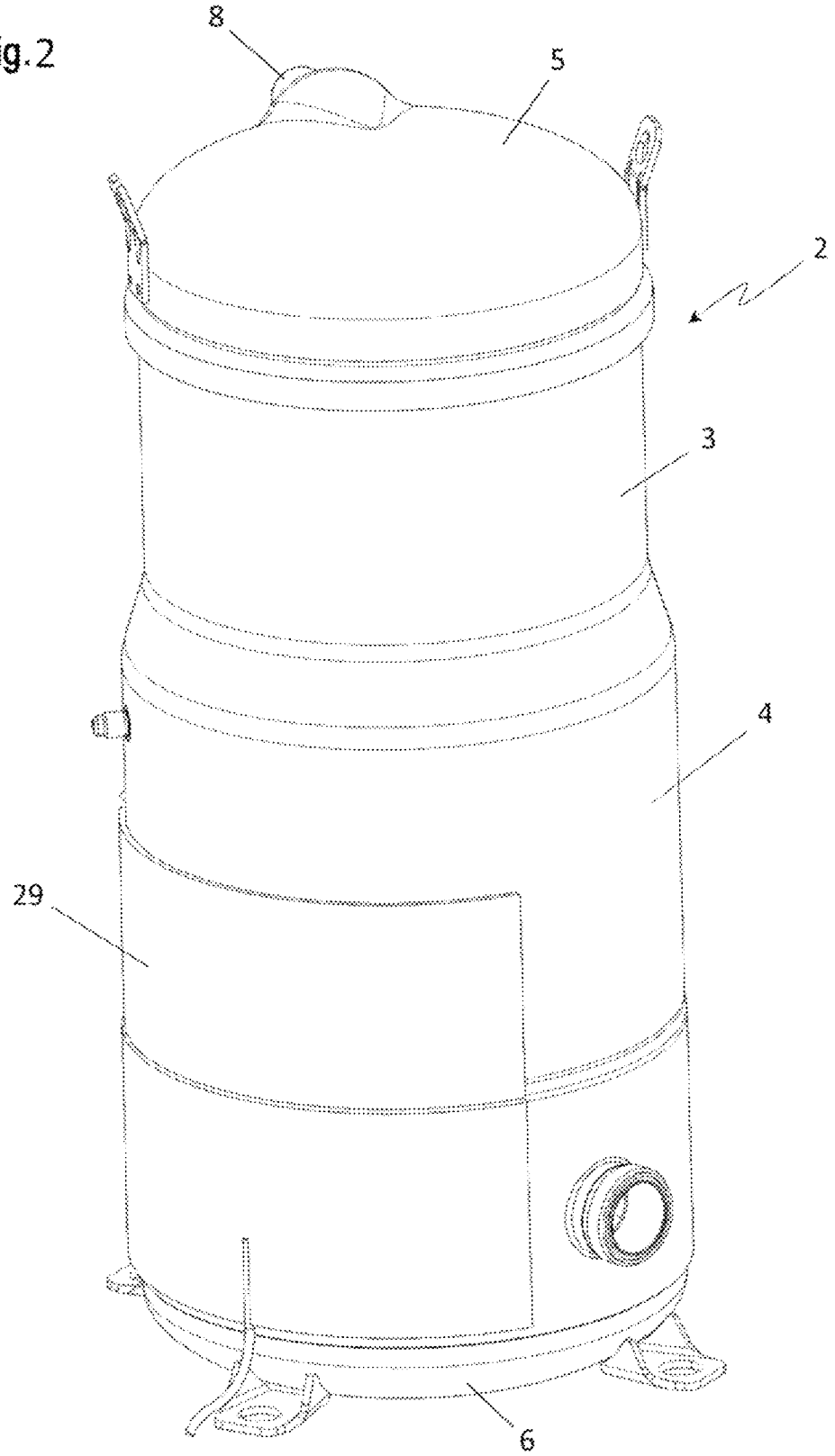
FIG. 2 is a perspective view of the scroll compressor of FIG. 1.
Figure 3:
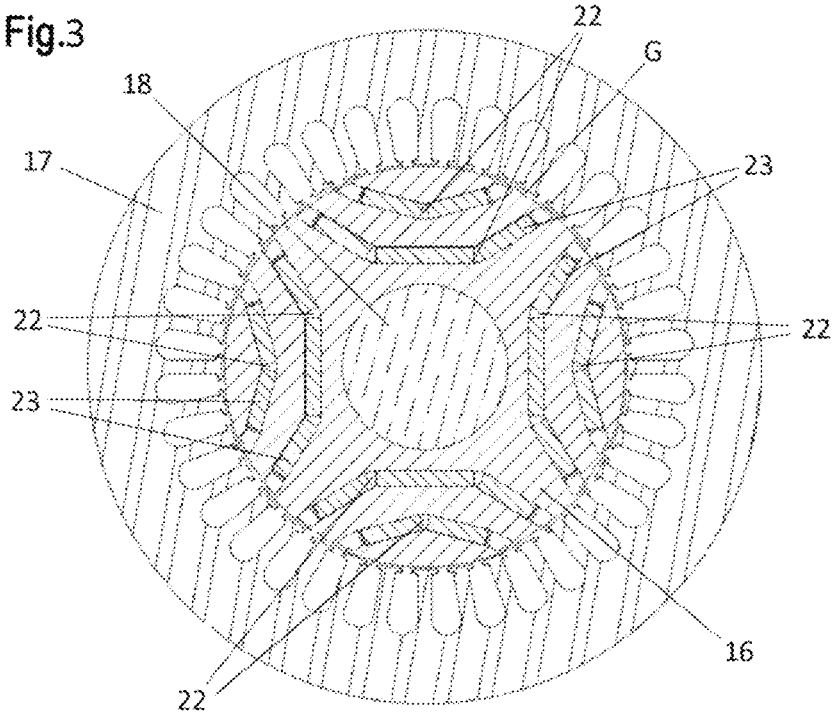
FIG. 3 is a sectional view of a synchronous reluctance motor of the scroll compressor of FIG. 1.

FIG. 1 shows a scroll compressor 2 according to a first embodiment of the present invention.

The scroll compressor 2 comprises a sealed housing 3, the sealed housing 3 being provided with a midshell 4, an upper cover 5 and a base plate 6. Advantageously, the midshell 4 is cylindrical, and comprises an upper end sealed by the upper cover 5 and a lower end sealed by the base plate 6.

The scroll compressor 2 further comprises: a suction opening 7 configured to supply refrigerant to be compressed to the scroll compressor 2, and a discharge opening 8 configured to discharge compressed refrigerant. For example, the suction opening 7 may be arranged on the midshell 4, and the discharge opening 8 may be arranged on the upper cover 5.

The scroll compressor 2 further comprises a support component 9 and a compression unit 11, the support component 9 is arranged in the sealed housing 3 and is fixed to the sealed housing 3, and the compression unit 11 is also arranged in the sealed housing 3 and is arranged above the support component 9. The compression unit 11 is configured to compress refrigerant supplied by the suction opening 7, and comprises a fixed scroll 12 and an orbiting scroll 13, the fixed scroll 12 is fixed relative to the sealed housing 3, the orbiting scroll 13 is supported by a thrust bearing surface 14 arranged on the support component 9, and is in sliding contact with the thrust bearing surface 14.

The scroll compressor 2 further comprises a synchronous reluctance motor 15, and the synchronous reluctance motor 15 is arranged in the sealed housing 3 and below the support component 9. The synchronous reluctance motor 15 may be a variable-speed synchronous reluctance motor. The synchronous reluctance motor 15 is provided with a rotor 16 and a stator 17, the stator 17 is disposed around the rotor 16 and is fixed to the midshell 4 of the sealed housing 3. Advantageously, an air gap G is defined between the stator 17 and the rotor 16.

In addition, the scroll compressor 2 comprises a drive shaft 18, the drive shaft 18 extends substantially vertically and can rotate around an axis of rotation A. The drive shaft 18 is coupled to the rotor 16 of the synchronous reluctance motor 15, such that the synchronous reluctance motor 15 is configured to drive the drive shaft 18 to rotate around the axis of rotation A. In particular, the drive shaft 18 is configured to drive the orbiting scroll 13 to move orbitally when the synchronous reluctance motor 15 operates.

Figure 4:
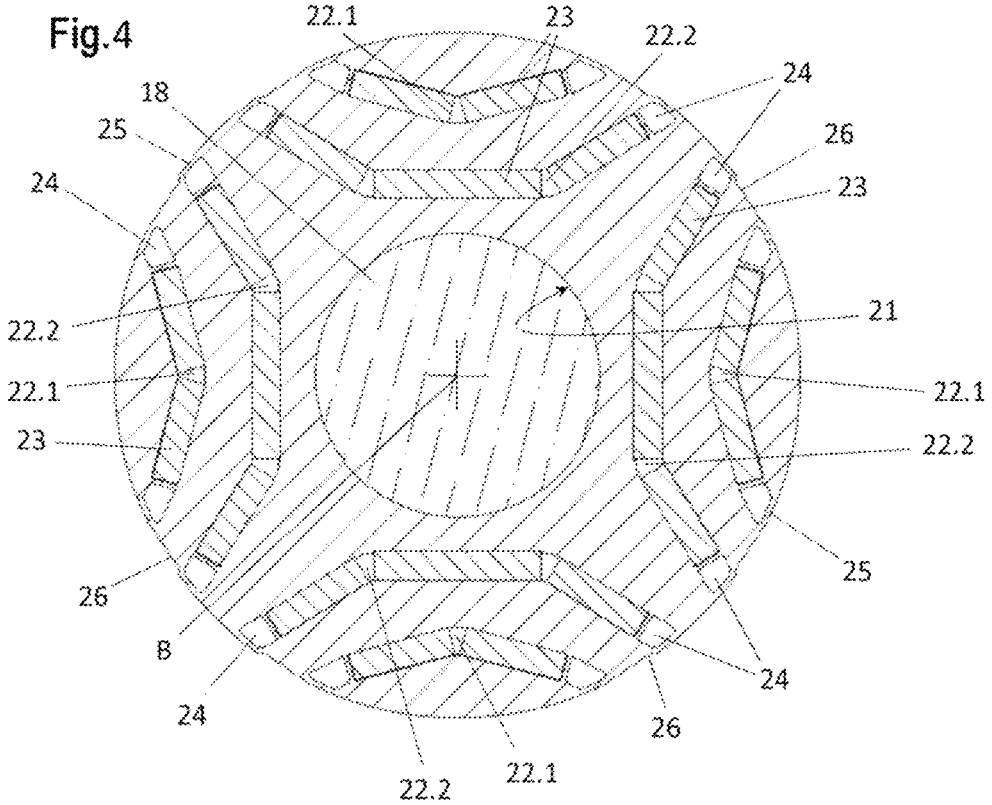
FIG. 4 is a sectional view of a rotor of the synchronous reluctance motor of FIG. 3.
Figure 5:
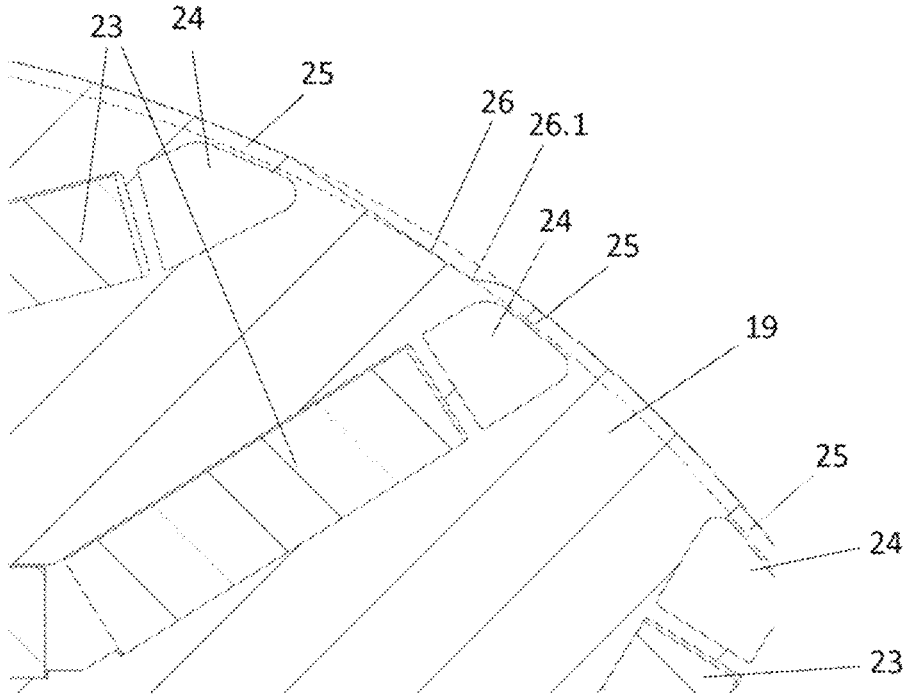
FIG. 5 is an enlarged view of details of FIG. 4.

As better shown in FIG. 4, the rotor 16 comprises a rotor lamination stack 19, and the rotor lamination stack 19 may also be called a rotor core. The rotor lamination stack 19 has a cylindrical shape as a whole, and the rotor lamination stack 19 is provided with an axial penetrating channel 21, and the drive shaft 18 extends and passes through the axial penetrating channel 21. The rotor lamination stack 19 may, for example, be formed from stacked sheet components.

The rotor lamination stack 19 is provided with a receiving slot 22, the receiving slot 22 extends along the whole axial length of the rotor lamination stack 19 and is substantially parallel to a longitudinal axis B of the rotor 16.

The rotor 16 further comprises a ferrite permanent magnet 23, the ferrite permanent magnet 23 is fitted in the receiving slot 22 and extends and passes through the rotor lamination stack 19. Each ferrite permanent magnet 23 has a strip shape and extends substantially parallel to the longitudinal axis B of the rotor 16. Advantageously, multiple ferrite permanent magnets 23 are arranged in each receiving slot 22, and each receiving slot 22 is only partially filled with the corresponding ferrite permanent magnets 23.

According to the embodiments shown in FIGS. 1 to 5, the rotor 16 is a four-pole rotor, and the receiving slots 22 comprise:

- four radial outer receiving slots 22.1, the four radial outer receiving slots 22.1 being distributed at angles around the longitudinal axis B of the rotor 16, and two ferrite permanent magnets 23 being arranged in each one of the four radial outer receiving slots 22.1; and
- four radial inner receiving slots 22.2, the four radial inner receiving slots 22.2 being distributed at angles around the longitudinal axis B of the rotor 16, and three ferrite permanent magnets 23 being arranged in each one of the four radial inner receiving slots 22.2.

According to the embodiments shown in FIGS. 1 to 5, the rotor lamination stack 19 is further provided with air sections 24 formed near end portions, of the receiving slots 22, facing the radial outer surface of the rotor 16. In particular, each receiving slot 22 extends between two corresponding air sections 24. Advantageously, each air section 24 extends along the whole axial length of the rotor lamination stack 19 and is substantially parallel to the longitudinal axis B of the rotor 16. The rotor lamination stack 19 may comprise partition wall portions, each partition wall portion separating the corresponding air section 24 from the corresponding receiving slot 22.

Advantageously, the rotor lamination stack 19 comprises a bridge section 25 formed between the radial outer surface of the rotor 16 and the air section 24. Advantageously, each bridge section 25 has a thin thickness.

The rotor lamination stack 19 further comprises multiple slender recesses 26, for example slender grooves, and the multiple slender recesses 26 are formed in the radial outer surface of the rotor 16 and extend substantially parallel to the longitudinal axis B of the rotor 16. Each slender recess 26 is located between two adjacent bridge sections 25 respectively associated with the radial outer receiving slot 22.1 and radial inner receiving slot 22.2. Advantageously, a deepest point 26.1 of each slender recess 26 is located near the adjacent bridge section 25 associated with the corresponding radial inner receiving slot 22.2. These slender recesses 26 result in a non-uniform air gap G between the rotor 16 and stator 17, which reduces torque fluctuations as a result of causing the flux density of the air gap between the outer periphery of the rotor 16 and inner circumference of the stator 17 to approach a sine curve.

The scroll compressor 2 further comprises: a lubricating oil tank 27 formed in a bottom portion of the sealed housing 3, and an oil temperature sensor 28 arranged in the lubricating oil tank 27. Advantageously, the stator 17, for example, is thermally connected to the lubricating oil tank via the sealed housing 3. Optionally, it is possible for a lower end of the stator 17 to be dipped in the lubricating oil tank 27 to make a thermal connection from the stator 17 to the lubricating oil tank 27 in a direct way. Therefore, a lubricating oil temperature measured by the oil temperature sensor 28 may act as an indication of a temperature of the ferrite permanent magnet 23.

The scroll compressor 2 further comprises a heating apparatus, and the heating apparatus is configured to heat lubricating oil stored in the lubricating oil tank 27. According to the embodiments shown in FIGS. 1 to 5, the heating apparatus comprises a resistance heater 29, and the resistance heater 29 is fixed to the midshell 4 of the sealed housing 3 and positioned immediately adjacent to the lubricating oil tank 27. The resistance heater 29 may be arranged on an outer surface of the midshell 4, and may at least partially extend around the lubricating oil tank 27. According to an alternative embodiment of the present invention, the resistance heater 29 may be fixed to the base plate 6 of the sealed housing 3 (and, for example, is arranged on an outer surface of a bottom portion of the base plate 6) or may be arranged in the lubricating oil tank 27 inside the sealed housing 3.

The scroll compressor 2 further comprises a compressor control apparatus 31, the compressor control apparatus 31 is configured to control the operation of the scroll compressor 2, and, in particular, is configured to control the operations of the synchronous reluctance motor 15 and resistance heater 29, on the basis of the lubricating oil temperature measured by the oil temperature sensor 28.

The compressor control apparatus 31 is specially configured to prevent the synchronous reluctance motor 15 from starting and to start the resistance heater 29, if the lubricating oil temperature measured by the oil temperature sensor 28 is less than a first predetermined temperature value, and to start the synchronous reluctance motor 15 and stop the resistance heater 29, if the lubricating oil temperature measured by the oil temperature sensor 28 is greater than or equal to the first predetermined temperature value. The first predetermined temperature value, for example, may be about −20° C.

In addition, the compressor control apparatus 31 is configured to apply a limited motor current to the synchronous reluctance motor 15, if the lubricating oil temperature measured by the oil temperature sensor 28 is between the first predetermined temperature value and a second predetermined temperature value greater than the first predetermined temperature value. The second predetermined temperature value, for example, may be about −10° C. Advantageously, the limited motor current is defined by the compressor control apparatus 31, such that the rotational speed of the rotor 16 is less than 10 rps, for example less than 5 rps, and advantageously is about 3 rps.

The compressor control apparatus 31 is further configured to:

collect the saturation temperature of refrigerant sucked in at the suction opening 7 of the scroll compressor 2;

compare the lubricating oil temperature measured by the oil temperature sensor 28 with the collected saturation temperature; and if a temperature difference between the measured lubricating oil temperature and collected saturation temperature is less than a threshold, start the resistance heater 29 and prevent the synchronous reluctance motor 15 from starting; and if the temperature difference between the measured lubricating oil temperature and collected saturation temperature is greater than or equal to the threshold, stop the resistance heater 29 and start the synchronous reluctance motor 15.

The saturation temperature may be derived from a suction pressure measured by a suction pressure sensor located at the suction opening 7 or near the suction opening 7, or is provided by a system controller connected to the compressor control apparatus 31. This type of temperature difference between the lubricating oil temperature and saturation temperature allows estimation of the presence of liquid refrigerant in a low-pressure chamber of the scroll compressor 2 and the amount of said liquid refrigerant. By means of using the heating apparatus to heat the lubricating oil held in the lubricating oil tank 27 before starting the synchronous reluctance motor 15, a flooded start and liquid refrigerant impacts which may result in damage to the scroll compressor 2 may be prevented.

According to an embodiment of the present invention, the compressor control apparatus 31 may be configured to detect an expansion valve fault, if the temperature difference between the lubricating oil temperature and collected saturation temperature, during an operating period of the scroll compressor, is less than a predetermined threshold.

According to an embodiment of the present invention, the compressor control apparatus 31 further may be configured to monitor a lubricating oil temperature measured by the oil temperature sensor 28, and detect a fault or even failure of the resistance heater 29 on the basis of the monitored lubricating oil temperature.

A method for controlling the scroll compressor 2 according to a first embodiment of the present invention comprises:

measuring a lubricating oil temperature in the lubricating oil tank 27; and according to the measured lubricating oil temperature, controlling the synchronous reluctance motor 15 and/or heating apparatus.

Advantageously, control steps comprise:

if the measured lubricating oil temperature is less than the first predetermined temperature value, starting the resistance heater 29 (to heat the lubricating oil held in the lubricating oil tank 27) and preventing the synchronous reluctance motor 15 from starting; and if the measured lubricating oil temperature is greater than or equal to the first predetermined temperature value, stopping the resistance heater 29 and starting the synchronous reluctance motor 15.

Advantageously, control steps further comprise:

if the measured lubricating oil temperature is between the first predetermined temperature value and the second predetermined temperature value, applying a limited motor current to the synchronous reluctance motor 15.

Control steps further may comprise:

collecting the saturation temperature of refrigerant sucked in at the suction opening 7 of the scroll compressor 2;

comparing the measured lubricating oil temperature with the collected saturation temperature;

if a temperature difference between the measured lubricating oil temperature and collected saturation temperature is less than a threshold, starting the resistance heater 29 (to heat the lubricating oil held in the lubricating oil tank 27) and preventing the synchronous reluctance motor 15 from starting; and if the temperature difference between the measured lubricating oil temperature and collected saturation temperature is greater than or equal to the threshold, stopping the resistance heater 29 and starting the synchronous reluctance motor 15.

According to a second embodiment of the present invention, the scroll compressor 2 lacks the resistance heater 29 arranged immediately adjacent to the lubricating oil tank 27, and the stator 17 of the synchronous reluctance motor 15 may operate to act as a heating apparatus.

According to the second embodiment of the present invention, the scroll compressor 2 comprises a variable speed drive 32 connected to the synchronous reluctance motor 15, and the compressor control apparatus 31 is configured to cause the variable speed drive 32 to operate in a stator heating mode, and, in the stator heating mode, the variable speed drive 32 applies a direct current to a stator winding of the stator 17, such that the stator winding generates heat to heat the lubricating oil stored in the lubricating oil tank 27. In particular, if the lubricating oil temperature measured by the oil temperature sensor 28 is less than the first predetermined temperature value, the variable speed drive 32 operates in the stator heating mode.

A method for controlling the scroll compressor 2 according to the second embodiment of the present invention comprises:

measuring a lubricating oil temperature in the lubricating oil tank 27;

if the lubricating oil temperature measured by the oil temperature sensor 28 is less than the first predetermined temperature value, causing the variable speed drive 32 to operate in the stator heating mode, and preventing the synchronous reluctance motor 15 from starting; and if the measured lubricating oil temperature is greater than or equal to the first predetermined temperature value, starting the synchronous reluctance motor 15.

Advantageously, the method further comprises:

if the measured lubricating oil temperature is between the first predetermined temperature value and the second predetermined temperature value, applying a limited motor current to the synchronous reluctance motor 15.

Of course, the present invention is not limited to the above-mentioned embodiments described by way of nonlimiting examples; on the contrary, the present invention comprises all embodiments thereof.

What is claimed is:

1. A scroll compressor, comprising:

a sealed housing, the sealed housing being provided with a suction opening, and the suction opening being configured to supply refrigerant to be compressed to the scroll compressor;

a compression unit, the compression unit being arranged in the sealed housing and being configured to compress refrigerant supplied by the suction opening, and the compression unit comprising a fixed scroll and an orbiting scroll;

a drive shaft, the drive shaft being arranged in the sealed housing and being configured to drive the orbiting scroll of the compression unit to move orbitally, and the drive shaft being capable of rotating around an axis of rotation;

a synchronous reluctance motor, the synchronous reluctance motor being arranged in the sealed housing and being configured to drive the drive shaft to rotate around the axis of rotation, the synchronous reluctance motor comprising a rotor, coupled to the drive shaft, and a stator disposed around the rotor, and the rotor comprising a ferrite permanent magnet;

a compressor control apparatus, the compressor control apparatus being configured to control the operation of the scroll compressor;

a lubricating oil tank, the lubricating oil tank being formed in a bottom portion of the sealed housing;

a heating apparatus, the heating apparatus being configured to heat lubricating oil stored in the lubricating oil tank; and an oil temperature sensor, the oil temperature sensor being arranged in the lubricating oil tank;

wherein the compressor control apparatus is configured to collect a lubricating oil temperature measured by the oil temperature sensor and apply a limited motor current to the synchronous reluctance motor if the lubricating oil temperature measured by the oil temperature sensor is between a first predetermined temperature value and a second predetermined temperature value greater than the first predetermined temperature value.

2. The scroll compressor as claimed in claim 1, wherein the compressor control apparatus is configured to start the heating apparatus, if the lubricating oil temperature measured by the oil temperature sensor is less than the first predetermined temperature value.

3. The scroll compressor as claimed in claim 2, wherein the compressor control apparatus is configured to stop the heating apparatus, if the lubricating oil temperature measured by the oil temperature sensor is greater than or equal to the first predetermined temperature value.

4. The scroll compressor as claimed in claim 1, wherein the limited motor current is defined by the compressor control apparatus, such that a rotational speed of the rotor is less than 10 rps.

5. The scroll compressor as claimed in claim 1, wherein the compressor control apparatus is configured to:

collect a saturation temperature of refrigerant sucked in at the suction opening of the scroll compressor;

compare a lubricating oil temperature measured by the oil temperature sensor with the collected saturation temperature; and if a temperature difference between the measured lubricating oil temperature and the collected saturation temperature is less than a threshold, start the heating apparatus and prevent the synchronous reluctance motor from starting.

6. The scroll compressor as claimed in claim 1, wherein the heating apparatus comprises a resistance heater.

7. The scroll compressor as claimed in claim 6, wherein the resistance heater is arranged in the lubricating oil tank in the sealed housing.

8. The scroll compressor as claimed in claim 6, wherein the resistance heater is arranged on an outer surface of the sealed housing, and is positioned immediately adjacent to the lubricating oil tank.

9. The scroll compressor as claimed in claim 1, wherein the rotor comprises a rotor lamination stack, the rotor lamination stack is provided with a receiving slot, and the ferrite permanent magnet is arranged in the receiving slot.

10. The scroll compressor as claimed in claim 9, wherein the receiving slots comprise:

four radial outer receiving slots, the four radial outer receiving slots being distributed at angles around a longitudinal axis of the rotor, and two ferrite permanent magnets being arranged in each one of the four radial outer receiving slots; and four radial inner receiving slots, the four radial inner receiving slots being distributed at angles around the longitudinal axis of the rotor, and three ferrite permanent magnets being arranged in each one of the four radial inner receiving slots.

11. The scroll compressor as claimed in claim 9, wherein the rotor lamination stack comprises an air section formed near an end portion, of the receiving slot, facing a radial outer surface of the rotor.

12. The scroll compressor as claimed in claim 11, wherein the rotor lamination stack comprises a bridge section formed between the air section and the radial outer surface of the rotor.

13. The scroll compressor as claimed in claim 12, wherein the rotor lamination stack comprises multiple slender recesses formed in the radial outer surface of the rotor, each slender recess is located between two adjacent bridge sections respectively associated with a radial outer receiving slot and a radial inner receiving slot, and a deepest point of each slender recess is located near the adjacent bridge section associated with the corresponding radial inner receiving slot.

14. The scroll compressor as claimed in claim 1, wherein a capacity of the scroll compressor is restricted when the limited motor current is applied to the synchronous reluctance motor by the compressor control apparatus.

15. The scroll compressor as claimed in claim 1, wherein the limited motor current is defined by the compressor control apparatus, such that a rotational speed of the rotor is less than 5 rps.

16. A scroll compressor, comprising:

a sealed housing, the sealed housing being provided with a suction opening, and the suction opening being configured to supply refrigerant to be compressed to the scroll compressor;

a compression unit, the compression unit being arranged in the sealed housing and being configured to compress refrigerant supplied by the suction opening, and the compression unit comprising a fixed scroll and an orbiting scroll;

a drive shaft, the drive shaft being arranged in the sealed housing and being configured to drive the orbiting scroll of the compression unit to move orbitally, and the drive shaft being capable of rotating around an axis of rotation;

a synchronous reluctance motor, the synchronous reluctance motor being arranged in the sealed housing and being configured to drive the drive shaft to rotate around the axis of rotation, the synchronous reluctance motor comprising a rotor, coupled to the drive shaft, and a stator disposed around the rotor, and the rotor comprising a ferrite permanent magnet;

a compressor control apparatus, the compressor control apparatus being configured to control the operation of the scroll compressor;

a lubricating oil tank, the lubricating oil tank being formed in a bottom portion of the sealed housing;

an oil temperature sensor, the oil temperature sensor being arranged in the lubricating oil tank; and a variable speed drive connected to the synchronous reluctance motor, the compressor control apparatus being configured to cause the variable speed drive to operate in a stator heating mode, and, in the stator heating mode, the variable speed drive applying a direct current to a stator winding of the stator, such that the stator winding generates heat to heat the lubricating oil stored in the lubricating oil tank.

17. A method for controlling a scroll compressor, the scroll compressor including:

a sealed housing, the sealed housing being provided with a suction opening, and the suction opening being configured to supply refrigerant to be compressed to the scroll compressor;

a compression unit, the compression unit being arranged in the sealed housing and being configured to compress refrigerant supplied by the suction opening, and the compression unit comprising a fixed scroll and an orbiting scroll;

a drive shaft, the drive shaft being arranged in the sealed housing and being configured to drive the orbiting scroll of the compression unit to move orbitally, and the drive shaft being capable of rotating around an axis of rotation;

a synchronous reluctance motor, the synchronous reluctance motor being arranged in the sealed housing and being configured to drive the drive shaft to rotate around the axis of rotation, the synchronous reluctance motor comprising a rotor, coupled to the drive shaft, and a stator disposed around the rotor, and the rotor comprising a ferrite permanent magnet;

a compressor control apparatus, the compressor control apparatus being configured to control the operation of the scroll compressor;

a lubricating oil tank, the lubricating oil tank being formed in a bottom portion of the sealed housing;

a heating apparatus, the heating apparatus being configured to heat lubricating oil stored in the lubricating oil tank; and an oil temperature sensor, the oil temperature sensor being arranged in the lubricating oil tank;

the method comprising:

measuring a lubricating oil temperature in the lubricating oil tank;

according to the measured lubricating oil temperature, controlling the synchronous reluctance motor and/or the heating apparatus; and applying a limited motor current to the synchronous reluctance motor if the measured lubricating oil temperature is between a first predetermined temperature value and a second predetermined temperature value greater than the first predetermined temperature value.

18. The method as claimed in claim 17, further comprising:

if the measured lubricating oil temperature is less than the first predetermined temperature value, heating the lubricating oil held in the lubricating oil tank.

19. The method as claimed in claim 18, wherein demagnetization of the ferrite permanent magnet due to low temperature is prevented by the heating and/or the applying a limited motor current to the synchronous reluctance motor.

20. The method as claimed in claim 17, wherein a capacity of the scroll compressor is restricted during the applying of the limited motor current to the synchronous reluctance motor.

* * * * *